US005261853A

United States Patent [19]

Suto

[11] Patent Number: 5,261,853

[45] Date of Patent: Nov. 16, 1993

[54] VEHICLE TOY WITH STEERABLE FRONT WHEELS AND CATERPILLARS

[75] Inventor: Shohei Suto, Tokyo, Japan

[73] Assignee: Taiyo Kogyo Co., Ltd., Tokyo, Japan

[21] Appl. No.: 992,589

[22] Filed: Dec. 18, 1992

[30] Foreign Application Priority Data

May 14, 1992 [JP] Japan ..... 4-146790

[51] Int. Cl.[5] ..... A63H 17/14; A63H 30/04; B60B 19/02; B62D 55/00

[52] U.S. Cl. ..... 446/433; 446/456; 305/15; 180/9.1

[58] Field of Search ..... 180/9.1, 8.7, 9, 9.32; 305/15, 16, 212, 24; 446/454, 456, 433, 468

[56] References Cited

U.S. PATENT DOCUMENTS

| | | | |
|---|---|---|---|
| 1,890,624 | 12/1932 | Shadish | 446/471 X |
| 2,832,426 | 4/1958 | Seargeant | 446/433 X |
| 3,651,579 | 3/1972 | Wilson | 180/9.1 X |
| 3,772,825 | 11/1973 | Gagnon | 446/433 X |
| 3,914,898 | 10/1975 | Ferguson | 446/470 |
| 3,933,214 | 1/1976 | Guibord et al. | 180/9.1 |
| 4,764,150 | 8/1988 | Uchino | 446/456 |
| 4,881,917 | 11/1989 | Suzuki et al. | 446/456 X |
| 5,135,427 | 8/1992 | Suto et al. | 446/433 |

FOREIGN PATENT DOCUMENTS

| | | | |
|---|---|---|---|
| 962725 | 2/1975 | Canada | 305/15 |
| 563814 | 12/1923 | France | 446/433 |
| 60-83690 | 6/1985 | Japan . | |

*Primary Examiner*—David N. Muir
*Attorney, Agent, or Firm*—Edward D. C. Bartlett

[57] ABSTRACT

A vehicle toy has the same roadability as that of a conventional toy provided with caterpillars, is controllable with the same control feel as that of a conventional four-wheeled toy, has reduced travelling load, and may travel at high speed. A body is supported by a chassis portion with front steerable wheels provided at the left and right of a front end of the chassis portion. Caterpillar front and rear wheels are both provided on the left and right of a central and a rear portion of the chassis portion with left and right caterpillars therearound. A drive unit drives the caterpillar rear wheels, and a power steering mechanism is disposed at the chassis front end. The forward extent of the caterpillars may be raised above the ground when the vehicle toy travels on a flat surface. The vehicle toy is battery powered and radio controlled.

16 Claims, 7 Drawing Sheets

VEHICLE TOY WITH STEERABLE FRONT WHEELS AND CATERPILLARS

BACKGROUND OF THE INVENTION

1. Field of the Invention

The present invention relates to a vehicle toy which can travel at high speed upon a rough road such as in off-road driving, and more particularly to a vehicle toy of this kind such as a tank toy and like vehicle toys provided with caterpillars.

2. Description of the Prior Art

In a conventional remote-controlled toy, there are various types of off-road travelling products which may be classified into two types of vehicle toys: four-wheel drive (i.e. 4 WD) vehicle toys each of which drives four wheels; and tank toys (i.e. war-vehicle toys) provided with caterpillars and the like. In a four-wheel drive vehicle toy, since the power from a drive motor is transmitted to its four wheels, more wheels can be driven in the four-wheel drive vehicle toy than in a conventional two-wheel drive vehicle toy. As a result, the four-wheel drive vehicle toy has a good roadability. Nevertheless, the four-wheel drive vehicle toy is often stuck in the sands, grass and the like. Further, the vehicle toy often suffers from its complex drive mechanism. On the other hand, in a tank toy and the like provided with caterpillars, since the tank toy is rich in caterpillar bearing area, the tank toy is not often stuck. In making a turn on the spot, the tank toy has its opposite caterpillars driven in opposite directions to produce a difference in rotation between the opposite caterpillars, which difference in rotation is used by the tank toy to change its travelling direction, and, therefore, the tank toy suffers from an increased load applied on its motor by the caterpillars, which increases battery power consumption of the tank toy and gives an operator of the tank toy a curious control feeling different from that of the conventional four-wheeled vehicle toy.

Namely, in the vehicle toy such as tank toys and the like provided with the conventional caterpillars, since the caterpillar bearing area of the vehicle toy is large, such vehicle toy suffers from the increased load on its motor (which load increases the battery power consumption), cannot travel at high speed, and makes a turn on the spot so that the vehicle cannot be controlled and make a turn in the same manner as that of the conventional wheeled toy.

SUMMARY OF THE INVENTION

It is an object of a preferred embodiment of the present invention to provide a vehicle toy which has substantially the same good roadability as that of a caterpillar-type vehicle toy, and enables its operator to control the vehicle toy with substantially the same feel as that of the conventional four-wheeled vehicle toy.

It is another object of a preferred embodiment of the invention to reduce the travelling load on the vehicle toy's motor so enabling the vehicle toy to travel at higher speed.

According to a first aspect of the present invention a vehicle toy comprises a body forming an upper-side vehicle body, a chassis portion forming a lower-side vehicle body to support the body, front wheels provided at the right and the left of a front-end side of the chassis portion, front and rear wheels for caterpillars provided at the right and the left of a central and a rear portion of the chassis portion, a right and a left caterpillar running round the front and rear wheels for caterpillars on the right and the left of the chassis portion, respectively, a steering portion for controlling in direction the front wheels provided at the right and the left of the front-end side, and a drive portion for driving the rear wheels for caterpillars.

According to another aspect of the invention each of the forward caterpillar wheels for the caterpillars is so mounted on the chassis portion as to permit a clearance to be provided between a lower surface of each of the caterpillars and a flat surface of a road under each of the front wheels for caterpillars. Each caterpillar is in the form of an endless belt, and in this way a lower flight of each caterpillar is inclined upwardly from each rear caterpillar wheel to each forward caterpillar wheel.

According to a third aspect of the invention the steering portion and the drive portion may be separately controlled through a radio control system.

As a result, in accordance with an embodiment of the present invention, the forward and rear wheels for caterpillars are provided at both the right and the left of the central and the rear portion of the chassis portion, and the right and the left caterpillars run round the forward and rear caterpillar wheels on the right and the left of the chassis portion, respectively. Consequently, in the present invention, it is possible to reduce in length each of the caterpillars to a length substantially equal to half the length of the conventional caterpillar of the tank toy and the like. This makes it possible by the present invention to reduce the caterpillar bearing area, for example to half the length of the vehicle toy, and therefore reduce frictional resistance. As a result, it is possible for the vehicle toy of the present invention to: reduce the travelling load on its motor; reduce its battery power consumption; travel at high speed; and, smoothly change its travelling direction.

Further, in accordance with another embodiment of the present invention, each of the forward wheels for caterpillars is so mounted on the chassis portion as to permit a clearance to be provided between a lower surface of each of the caterpillars and a flat surface of a road under each of the front caterpillar wheels. Consequently, in on-road driving in which the vehicle toy travels upon a flat surface of a road, the vehicle toy of the present invention is supported by substantially four points on the road, which enables the vehicle toy to reduce its road resistance and to smoothly change its travelling direction. In addition, in off-road driving in which the vehicle toy travels upon rough ground and the like, the caterpillars improve the vehicle toy of the present invention in roadability and more fully engage the rough ground.

In further another embodiment of the present invention, the steering portion and the drive portion are separately controlled through the radio control. Consequently, in contrast with the tank toy and the like provided with the conventional caterpillars, the vehicle toy of the present invention enables its operator to control the vehicle toy in substantially the same manner as that of the conventional four-wheeled vehicle toy, and, therefore does not give the operator any curious feeling in operation.

Other objects, features and advantages of the present invention will become more fully apparent from the following detailed description of the preferred embodiments, the appended claims and the accompanying drawings.

DESCRIPTION OF THE PREFERRED EMBODIMENTS

The present invention will now be described in greater detail with reference to the drawings.

Figure 1:
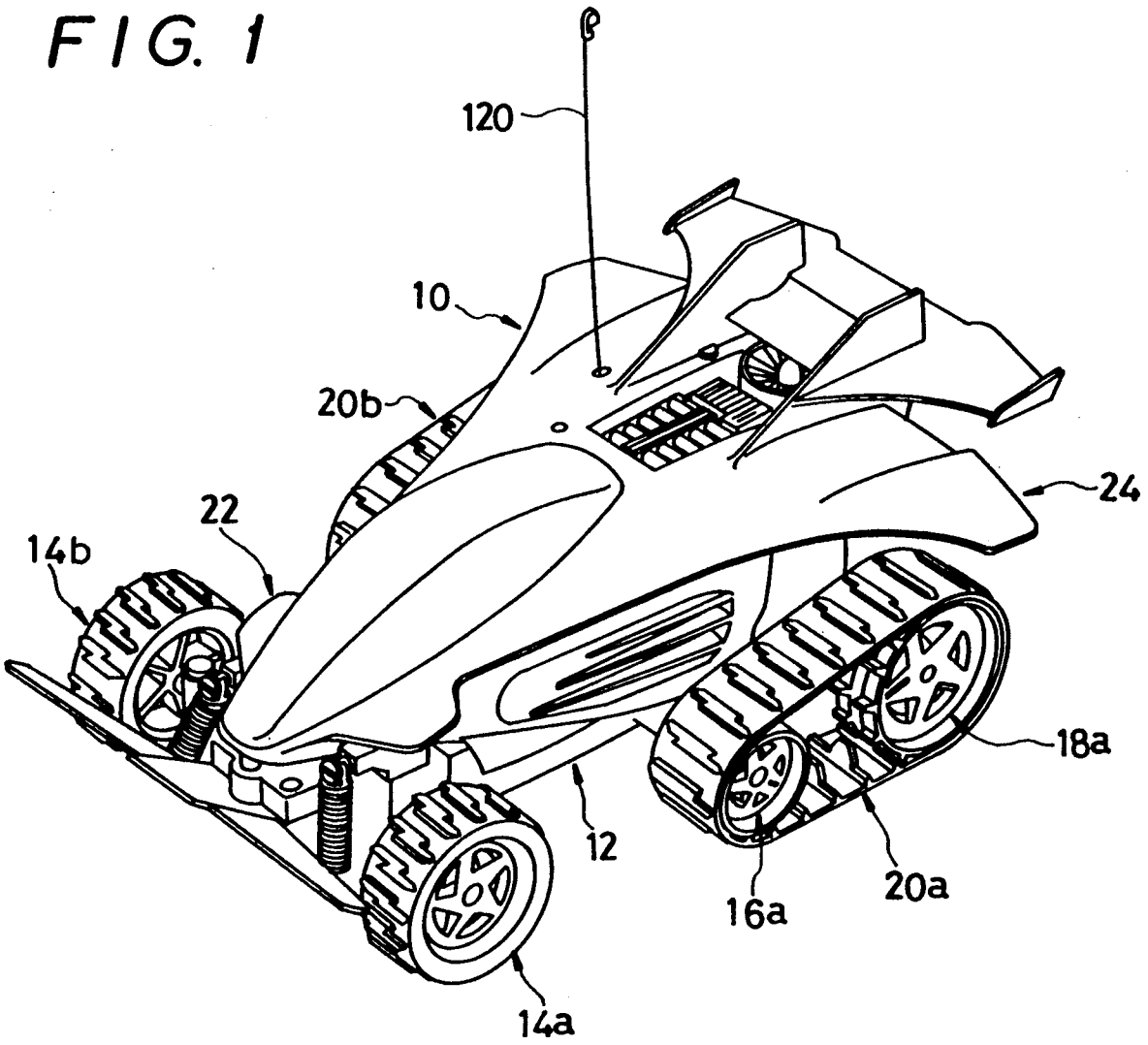
FIG. 1 is a perspective view of an embodiment of a vehicle toy in accordance with the present invention.
Figure 2:
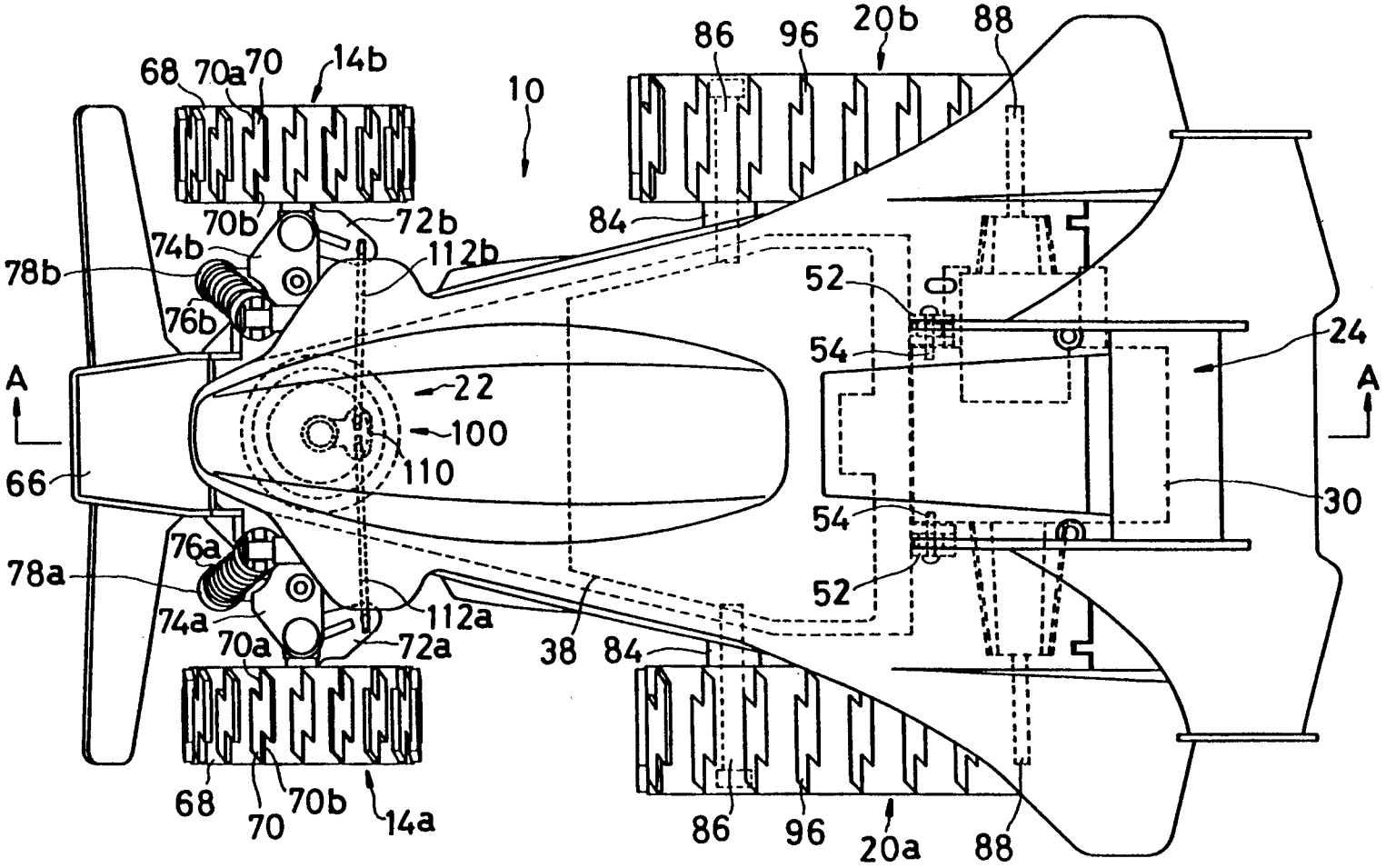
FIG. 2 is a plan view of the vehicle toy shown in FIG. 1.

As shown in FIG. 1, a vehicle toy of an embodiment of the present invention is provided with a body 10 forming an upperside portion vehicle body thereof, and a chassis portion 12 which forms a lowerside portion vehicle body to support the body 10 disposed thereon. In a front side of the vehicle toy, a left front steerable road wheel 14*a* and a right front steerable road wheel 14*b* are provided on a left and a right side of a front end of the chassis portion 12, respectively. Caterpillar front or forward wheels 16*a*, 16*b* are provided on opposite sides of a substantially central portion of the chassis portion 12, while caterpillar rear wheels 18*a*, 18*b* are provided on opposite sides of a rear-end portion of the chassis 12. Running round the caterpillar front wheels 16*a*, 16*b* and the caterpillar rear wheels 18*a*, 18*b* are a left caterpillar 20*a* and a right caterpillar 20*b*. A steering portion 22 for changing travelling directions of the left front wheel 14*a* and the right front wheel 14*b* are disposed in a front-end portion of the chassis portion 12. On the other hand, as shown in FIGS. 2 and 4, a drive portion 24 for driving the left caterpillar rear wheel 18*a* and the right caterpillar rear wheel 18*b* is disposed in a rear-end portion of the chassis portion 12.

The body 10 is molded of, for example, plastics and the like, has its front-end portion slightly elongated and pointed so as to imitate a cockpit, and has its rear-end portion gradually broadened horizontally to the left and the right of the vehicle toy to form horizontal and vertical wings in its rear-end portion, whereby the body 10 as a whole is so formed as to imitate a high-speed vehicle such as an automobile.

Figure 4:
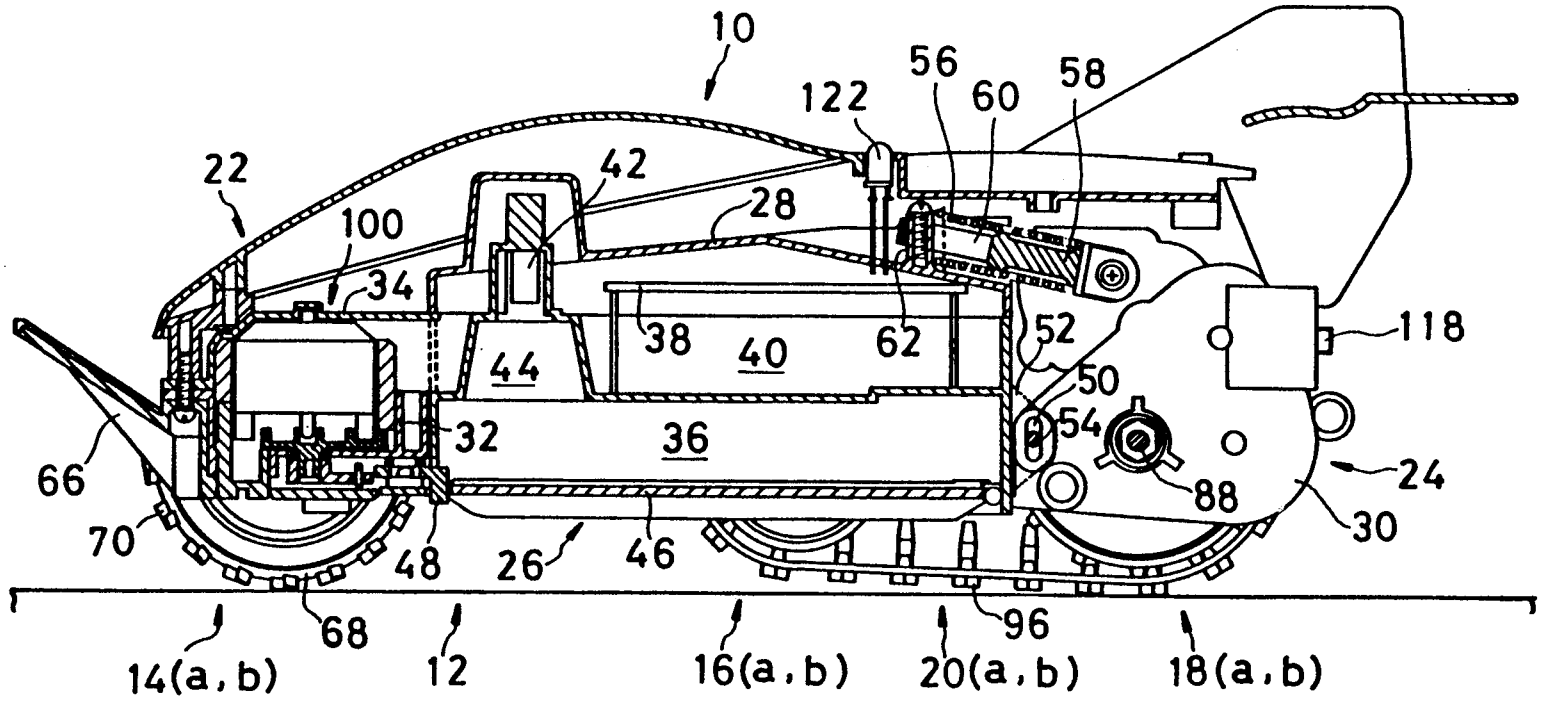
FIG. 4 is a cross-sectional view of the vehicle toy, taken along the line A—A of FIG. 2.

Referring to FIG. 4, the chassis portion 12 is molded of plastics and the like, and is constructed of a chassis main body 26 forming a lower frame disposed in a substantially central portion of the vehicle body, a cover 28 covering an upper-side opening portion of the chassis main body 26, a gear casing 30 for housing a motor and gears of the drive portion 24 disposed in the rear-end portion of the vehicle toy, a casing 32 for housing a servo-mechanism and the like in the steering portion 22, which servo-mechanism and the like will be described later, and a cover 34 or the like for covering an upper-side opening portion of the casing 32.

The chassis main body 26 and the cover 28 covering the upper side of the main body 26 are formed into a substantially ox-like shape as a whole, which shape at its front-end becomes slightly narrower and has the interior thereof divided into two compartments, i.e. an upper compartment and a lower compartment. The lower compartment forms a battery housing chamber 36. On the other hand, the upper compartment forms a housing portion 40 for housing a printed circuit board 38 provided with a receiving circuit which will be described later. Further, in front of the battery housing chamber 36, there is formed a housing portion 44 for housing a battery terminal portion 42 projecting into the side of the upper housing portion 40. In a lower opening of the battery housing chamber 36 is provided a lid 46 for covering the bottom of chamber 36. The lid 46 is pivotally mounted at its rear edge on the chassis main body 26, and its front edge is detachably engaged by a latch or stopper 48 for retaining the lid 46 closed.

The gear casing 30 is formed into an enclosed box-like shape for housing a motor, gears and the like, and has drive shafts 88, 88 projected transversely, on which drive shafts 88, 88 the caterpillar rear wheels 18*a*, 18*b* are mounted. As is clear from FIG. 4, formed in opposite sides of a lower-side portion of the gear box 30 are elongated slots 50 which extend vertically. Inserted in the slots 50 are pivot pins 54 mounted on a pair of ears 52 extending rearwardly from the rear-end of the chassis main body 26. An upper-side portion of the gear box 30 is connected with the cover 28 by a guide rod 58 on which a compression coil spring 56 is mounted. Formed in a front end of the guide rod 58 is a slit 60 in which an upwardly extending support 62 is slidably mounted. The support 62 projects from an upper surface of the rear of the cover 28. The gear box 30 is supported adjacent its front end by the pivot pins 54 so as to be capable of moving vertically relative to the main body 26 and independently on opposite sides thereof. The gear box 30 is telescopically connected, above and rear of the pins 54, with the cover 28 by the guide rod 58. As a result, the road impact transmitted to the vehicle toy through the caterpillar rear wheels 18*a*, 18*b* is reduced, because both the caterpillar rear wheels 18*a*, 18*b* and the gear box 30 are vertically movable relative to the cover 28 against the resilient force exerted by the compression coil spring 56 mounted on the guide rod 58. This arrangement enables the vehicle toy to travel upon a rough road with minimum or reduced adverse influence from the road.

Figure 6:
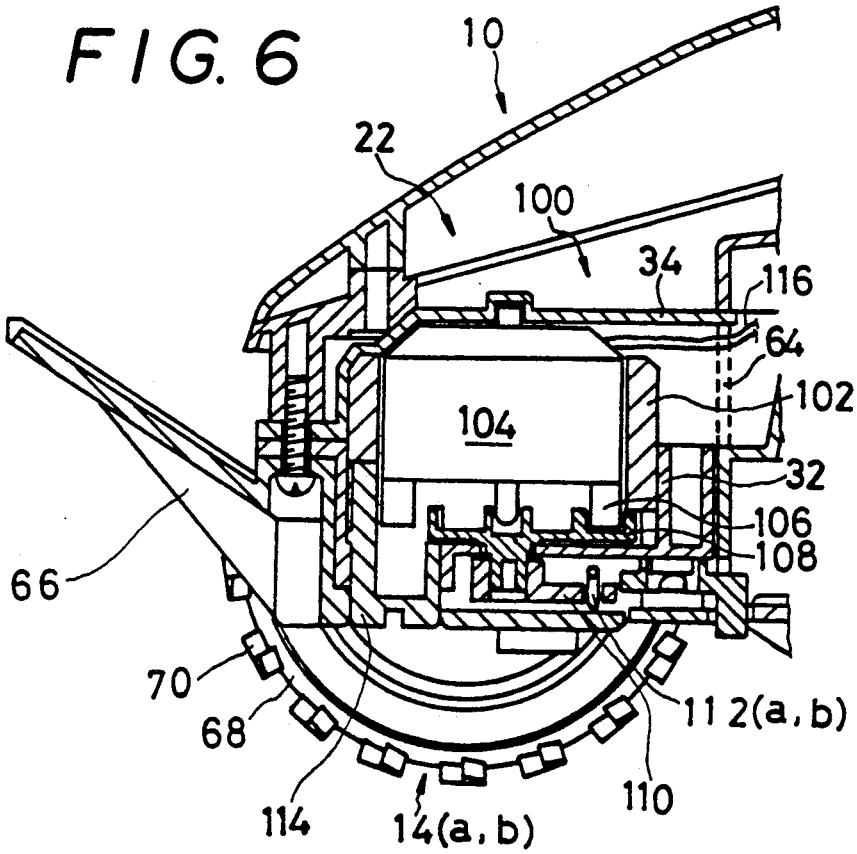
FIG. 6 is an enlarged sectional view of a servo-mechanism portion in a steering portion of the vehicle toy shown in FIG. 1.

Referring to FIG. 6, the casing 32 (in which the steering servo-mechanism and the like are housed) and the cover 34 are mounted in the front-end of the chassis main body 26. Formed in the casing 32 is an opening 64 through which a wire 116 passes for connecting the printed circuit board 38 of the housing portion 40 with the steering servo-mechanism. Further, mounted in front of both the casing 32 and the cover 34 is an impact bumper 66 which has its front-end extended from a central portion of the front-end portion to both the right and left of the vehicle toy in front of the front wheels 14*a*, 14*b* to form a plate-like shape which is inclined upward and forwardly, as is clear from FIGS. 2 and 6. Since the plate-like bumper 66 is so formed as to position the opposite-side portions of its front end in front of the front wheels 14*a*, 14*b* and is inclined as shown, it is possible to prevent the bumper portion 66 from directly hitting against the front wheels 14*a*, 14*b*. Thereby the bumper 66 is permitted to pass an obstacle on the road when the vehicle toy encounters such obstacle in travelling, because the obstacle hits against the inclined bumper 66 and lifts it upward by pushing upwardly on the lower surface of the bumper 66 as the vehicle toy is driven forwards.

The front wheels 14*a*, 14*b* on the left and right sides of the vehicle toy are molded of plastics or the like, and have their peripheries provided with tires 68 made of rubber or the like. Formed in a peripheral surface of each of the tires 68 is a tread pattern constructed of a row of projections 70 equally spaced as shown in FIG. 2. Each of the projections 70 is so formed as to have, for example, a height of approximately 2 mm, to extend generally in a width direction of the tire 68, and to have a substantially Z-shaped pattern as is clear from FIG. 2. In the Z-shaped pattern, the projection 70 has areas adjacent to its opposite-end sides formed into a forward-oriented groove portion 70*a* and a rearward-oriented groove portion 70*b*. Due to the form of each of the projections 70, it is possible to increase the traction of the vehicle toy in driving both forward and backward. Each of the left and right front wheels 14*a*, 14*b* is rotatably mounted on an end portion of each of substantially L-shaped left and right knuckles 72*a*, 72*b*, as shown in FIG. 2. Each of the left and right knuckles 72*a*, 72*b* is mounted on each of left and right knuckle supports 74*a*, 74*b* so as to be rotatable in a horizontal plane. Further, each of the left and right knuckle supports 74*a*, 74*b* has its end-portion side (i.e. its central portion side) rotatably mounted on a lower surface of the casing 32. In addition, the other end-portion sides of the left and right knuckle supports 74*a*, 74*b* are connected with the cover 34 through left and right telescopic guide rods 78*a*, 78*b* which are telescopically operated against the resilient forces exerted by left and right compression coil springs 76*a*, 76*b*. As a result, in travelling, the impact transmitted from the road to the vehicle toy through the front wheels 14*a*, 14*b*, knuckles 72*a*, 72*b* and the knuckle supports 74*a*, 74*b* is reduced, because all of the front wheels 14*a*, 14*b*, knuckles 72*a*, 72*b* and knuckle supports 74*a*, 74*b* move independently vertically on opposite sides, and because clearances between the knuckle supports 74*a*, 74*b* and the cover 34 change against the resilient forces exerted by the compression coil springs 76*a*, 76*b*, whereby the influence of the rough road upon the vehicle toy in travelling is reduced.

Figure 3:
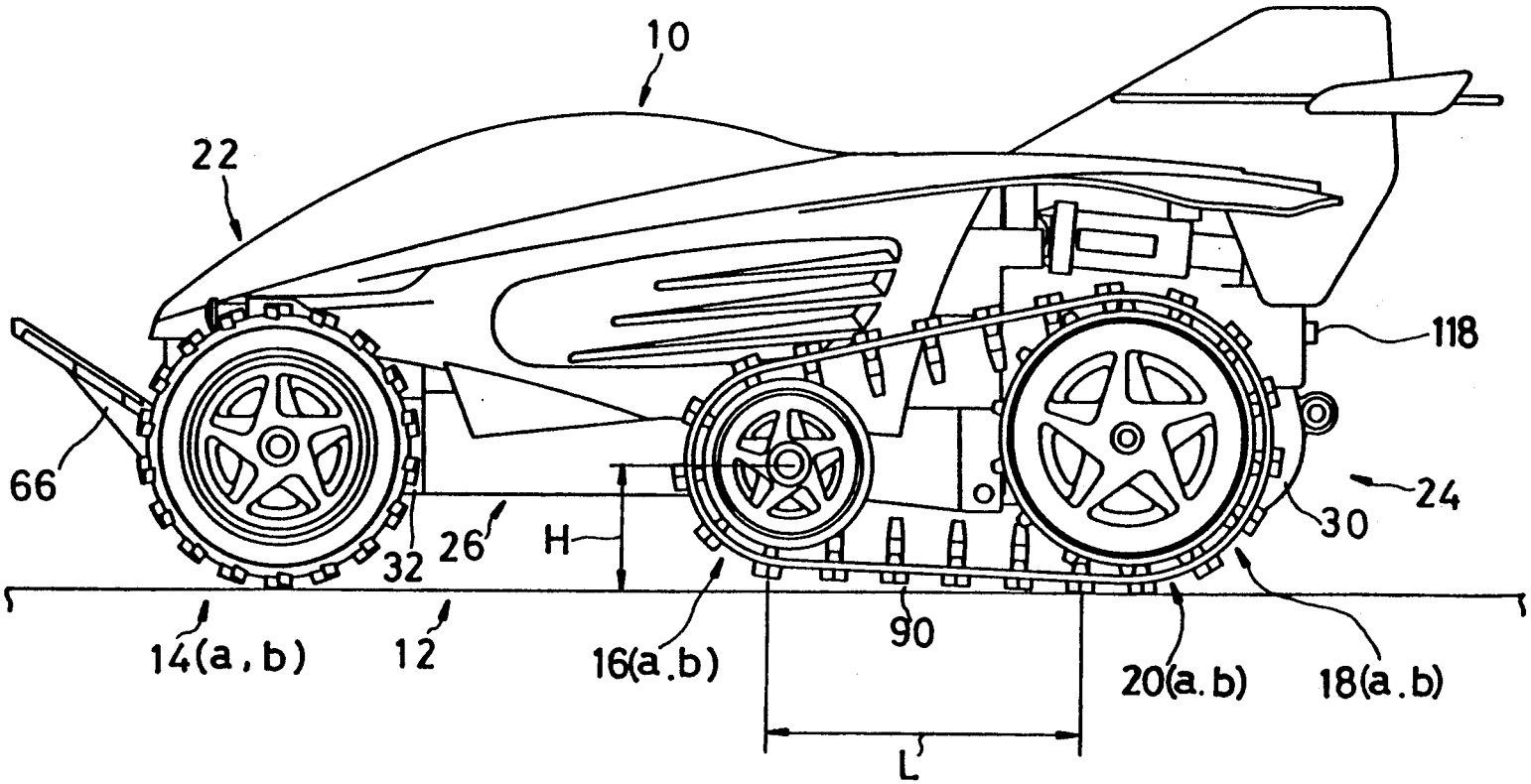
FIG. 3 is a side view of the vehicle toy shown in FIG. 1.
Figure 5:
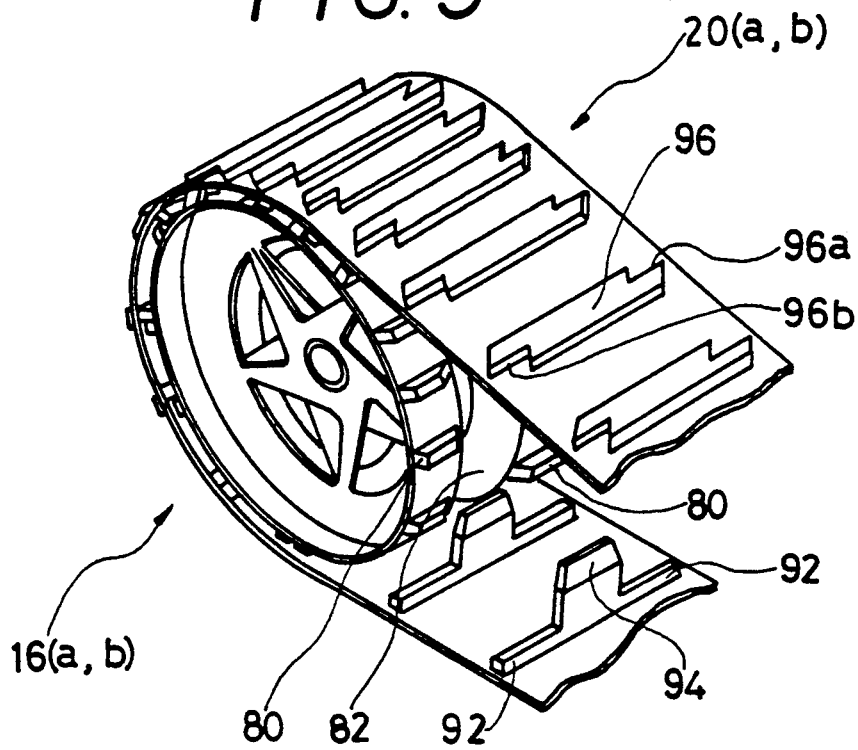
FIG. 5 is a perspective view of a wheel and a caterpillar portion of the vehicle toy shown in FIG. 1.

As is clear from FIG. 5, each of the caterpillar front wheels 16*a*, 16*b* and the caterpillar rear wheels 18*a*, 18*b* is molded of plastics or the like, and has the peripheral portion formed into a pair of rows of gear teeth 80, 80 which are equally spaced apart from each other and extend widthwise. Formed between the gear teeth 80, 80 is an annular groove 82. Each of the caterpillar front or forward wheels 16*a*, 16*b* is smaller in diameter than each of the caterpillar rear wheels 18*a*, 18*b*. The wheels 16*a*, 16*b* are rotatably mounted on axles 86 mounted in bosses 84, as shown in FIG. 2 in dotted lines. The bosses 84 extend horizontally from opposite side surface portions of the chassis main body 26. The caterpillar rear wheels 18*a*, 18*b* are mounted on drive shafts 88 which extend horizontally from opposite side surface portions of the gear box 30. As shown in FIG. 3, each of the caterpillar front wheels 16*a*, 16*b* is mounted at a height H above the flat surface of the road, H being slightly greater than the effective radius of each front wheel 16*a*, 16*b* with the respective caterpillar thereon to raise the wheels 16*a*, 16*b* and the caterpillars thereon above the flat surface of the road. Thus, most of the lower surface of each of the left and right caterpillars 20*a*, 20*b* do not touch the flat surface of the road, a clearance 90 being produced between each of the caterpillars 20*a*, 20*b* and the flat surface of the road in a distance range L from an underside of each of the caterpillar forward wheels 16*a*, 16*b* to a position slightly before the underside of each of the caterpillar rear wheels 18*a*, 18*b*.

The caterpillars 20*a*, 20*b* are molded of rubber or the like, and as shown in FIG. 5, have the inner-surface side formed into a pair of rows of tooth-like projections 92, 92 which are low in height and are meshed with the pair of rows of the gear teeth 80, 80 formed in the supporting wheel. Formed between these rows of the projections 92, 92 is a row of projections 94 each of which is slightly higher and is engaged in the groove 82 formed between the gear teeth 80, 80. Further, formed in an outer-surface side of each of the caterpillars 20*a*, 20*b* is a row of projections 96 each of which has substantially the same Z-shaped pattern as that of the front wheel tires 70, which pattern extends transversely. Due to the pattern of the row of these projections 96, it is possible for the caterpillars 20*a*, 20*b* to increase their traction when driving the vehicle toy both forwards and backwards.

Referring to FIG. 6, the steering portion 22 is provided with a servo-mechanism 100 for changing the travelling direction of the front wheels 14*a*, 14*b*. It is constructed of a ring-like magnet 102, a magnet coil 104 disposed inside the magnet 102, a link 108 engaged with a projecting portion 106 which is so formed in a lower surface of the magnetic coil 104 as to be disposed at an off-center position of the lower surface, a link 110 connected with the link 108, and left and right tie rods 112*a*, 112*b* (see FIG. 2) each of which has one of its opposite ends connected with the link 110 and the other connected with an end portion of each of the knuckles 72*a*, 72*b*. The ring-like magnet 102 is housed in the casing 32 enclosed with the cover 34, and is engaged with an offset adjusting pin 114 provided in a front-end lower portion of the casing 32. By rotating the adjusting pin 114 which is accessible from the bottom of the vehicle toy, it is possible to adjust the ring-like magnet 102 in rotational position. Rotating the adjusting pin 114 like this enables the operator to precisely adjust the front wheels 14*a*, 14*b* in their directional alignment as may be necessary due to both a variation in the dimensions of the parts and any misalignment in assembling. The magnetic coil 104 is loosely fitted in the ring-like magnet 102 so as to be rotatable therein, and is rotated through a predetermined angle under the influence of a magnetic force produced by a control electric current supplied from the wire 116 connected with the circuit board 38 through the opening portion 62. When control electric current is not supplied via wire 116, the magnetic coil 104 remains in its initial position under the influence of the magnetic force of the ring-like magnet 102. Torque of the magnetic coil 104 is transmitted from the link 108 (which engages the projecting portion 106) to the link 110, tie rods 112*a* and 112*b* to change direction of the front wheels 14*a*, 14*b*.

The drive portion 24 is a known unit for driving the caterpillar rear wheels 18*a*, 18*b*, and is constructed of a motor and a speed-reduction mechanism. The motor is controlled by the control electric current supplied from the printed circuit board 38 to rotate in a forward direction, a backward direction and to stop. The speed-reduction mechanism comprises gears or the like for transmitting the torque of the motor. The speed-reduction mechanism is provided with a mechanism which is capable of switching the driving mode of the vehicle toy from high-speed drive to low-speed drive and vice versa when the operator manually slides a lever 118 which is provided in, for example, a rear-surface side of the gear casing 30, as shown in FIGS. 3 and 4.

In FIGS. 1 and 4, 120 denotes a receiving antenna, and 122 an LED (light emitting diode) which lights when power is turned on by an electric-power switch.

In the embodiment of the present invention shown in the drawings, a radio-control system of the vehicle toy transmits a control signal controlled by a control stick which is operated in a transmitter. Such control signal is received by a receiver mounted on the vehicle toy to control separately the motor in the drive portion 24, and the magnetic coil 104 in the steering portion 22. The circuit of the transmitter, i.e. the transmitting circuit, corresponds to the circuit mounted on the printed board 38.

Figure 7:
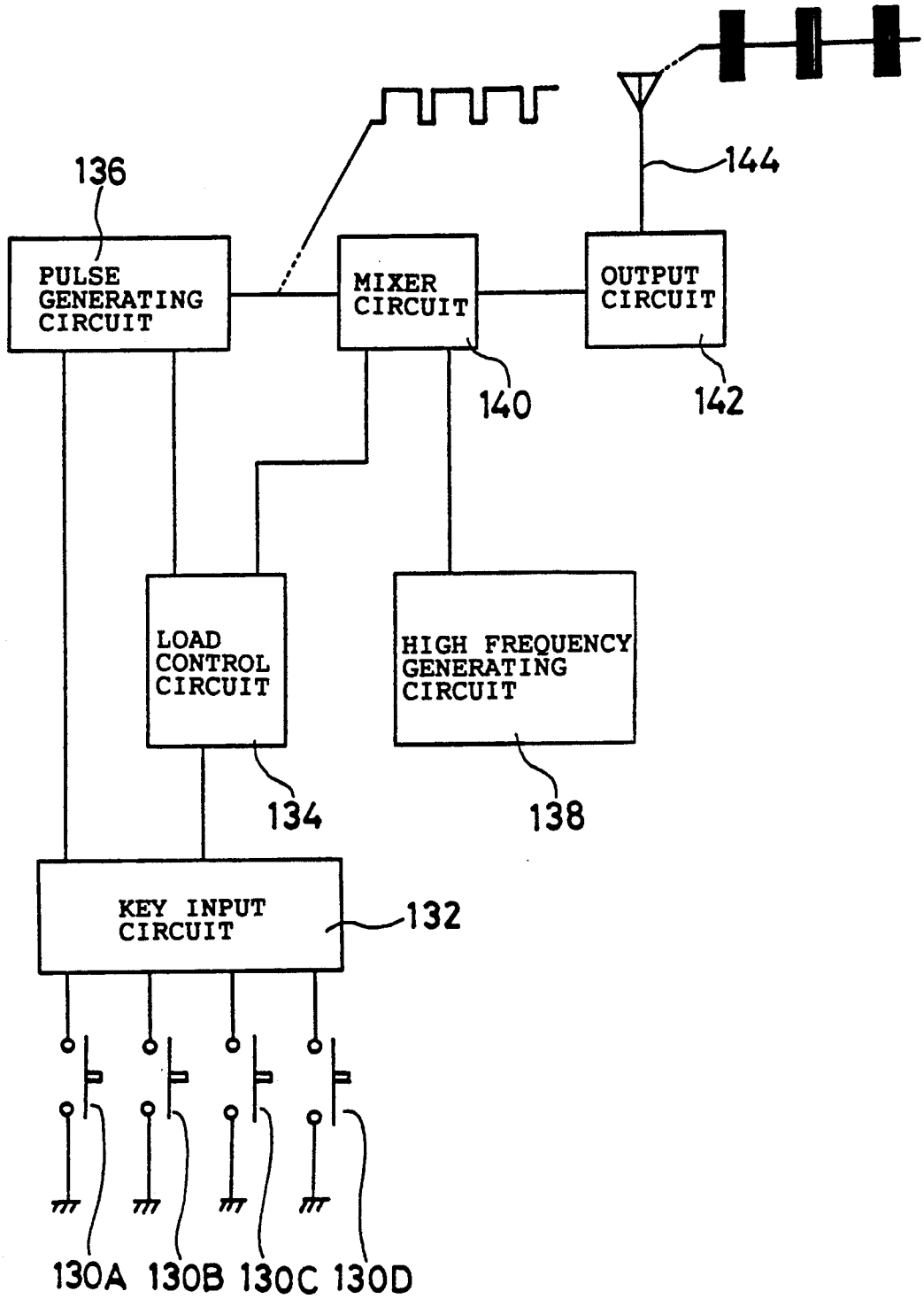
FIG. 7 is a block diagram of a transmitting circuit of the vehicle toy shown in FIG. 1.
Figure 8:
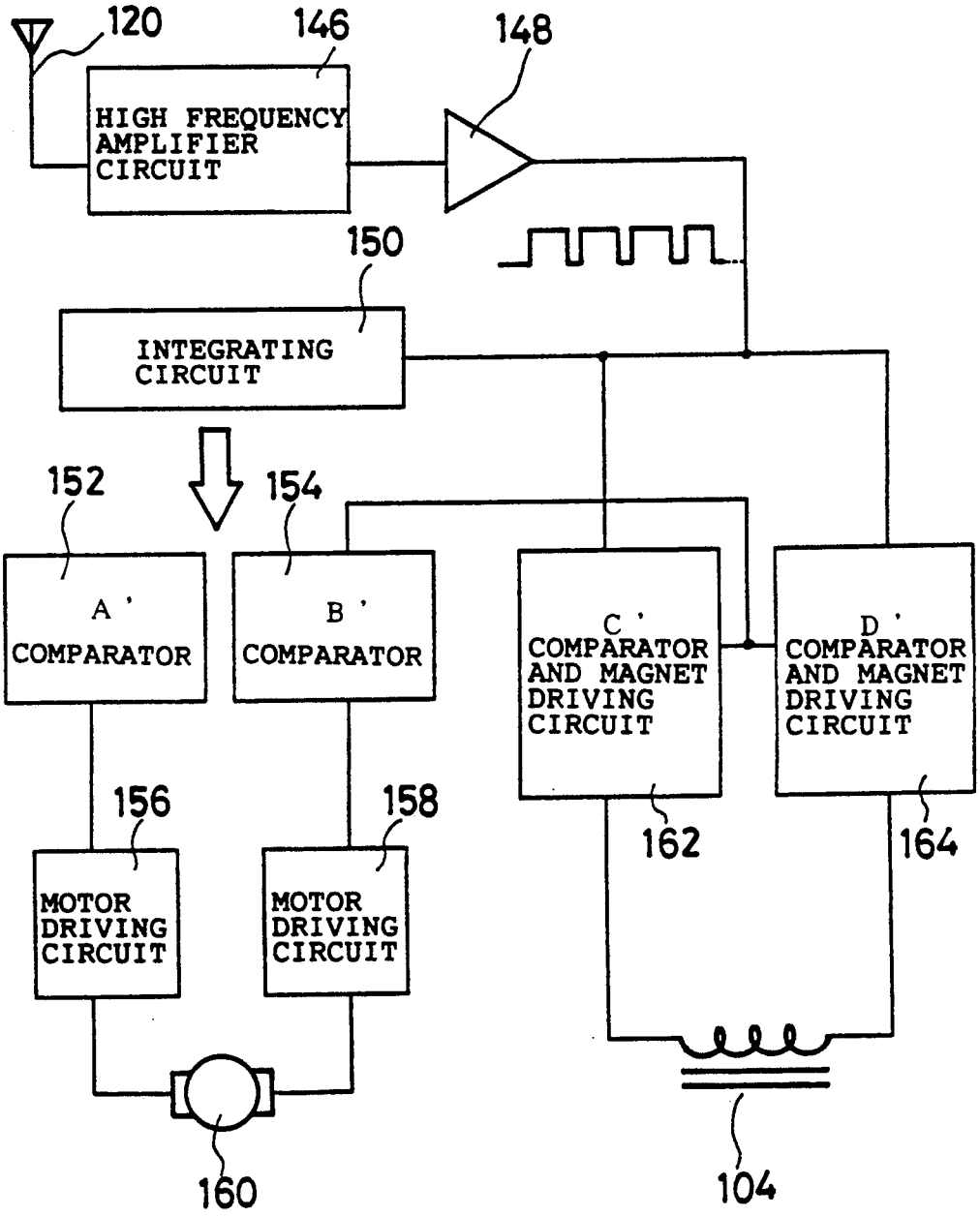
FIG. 8 is a block diagram of a receiving circuit of the vehicle toy shown in FIG. 1.

Referring to FIG. 7, in the transmitting circuit, each of the reference numerals 130A, 130B, 130C and 130D denotes an on-off switch interlocked with the control stick, 132 a key-input circuit for detecting an on-off condition of the switches 130A, 130B, 130C and 130D, 134 a load-control circuit, 136 a pulse-generating circuit, 138 a high-frequency generating circuit, 140 a mixer circuit, 142 an output circuit, and 144 a transmitting antenna. Here, for example, when switch 130A is turned on, the motor rotates for forward travel. On the other hand, when the switch 130B is turned on, the motor drives for backward (or reverse) travel. When both switches 130A, 130B are turned off, the motor stops. The switches 130A, 130B cannot both be turned on at the same time. In the same manner, when the switch 130C is turned on, the magnetic coil 104 is turned clockwise (when viewed in FIG. 2). On the other hand, when the switch 130D is turned on, the magnetic coil 104 is turned counterclockwise in FIG. 2. When both switches 130C, 130D are turned off, the magnetic coil 104 stops in rotation. The switches 130A, 130B, 130C and 130D cannot be operated at the same time. In the transmitting circuit shown in FIG. 8, the reference numeral 120 denotes a receiving antenna, 146 a high-frequency amplifier and a detector circuit, 148 an amplifier circuit, 150 an integrating circuit, 152 a comparator A', 154 a comparator B', each of 156 and 158 denotes a motor driving circuit, 160 the travelling motor in the drive portion 24 for driving the vehicle toy, 162 a comparator C' and a magnet driving circuit, 164 a comparator D' and a magnet driving circuit, and 104 the magnetic coil (shown also in FIG. 6).

When the control stick provided in the transmitter of the radio control system is operated, the switches 130A, 130B, 130C and 130D are turned on and off so that on-off conditions of these switches are detected by the key-input circuit 132 which then issues a detection signal. The load-control circuit 134 issues a control signal corresponding to the detection signal issued from the key-input circuit 132. The control signal issued from the load-control circuit 134 is mixed with a carrier wave generated in the high-frequency generating circuit 138, then amplified in the output circuit 142, and issued as a radio wave from the transmitting antenna 144. The thus issued radio wave is received by the receiving antenna 120, demodulated through the high-frequency amplifier and the detector circuit 146 and the amplifier circuit 148 to produce a signal which corresponds to the input control signal, and is supplied to the travelling motor 160 through the integrating circuit 150, comparators A' and B' and the motor driving circuits 156, 158 to control the travelling motor 160 to rotate forwards, backwards, or stop.

Now, the vehicle toy will be described in operation. First, when the operator operates the transmitter of the radio controller so as to have the vehicle toy move forward, the travelling motor 160 in the drive portion 24 rotates forward so that the drive shafts 88, 88 are rotatably driven forward through the reduction mechanism, whereby both of the caterpillar rear wheels 18A, 18B are rotatably driven forward to drive the vehicle toy in a forward direction, i.e. to the left in FIGS. 2, 3 and 4. Torque is transmitted from the caterpillar rear wheels **18*a*, 18*b* to the left and right caterpillars 20*a*, 20*b* to move the vehicle toy forward. Then, when the transmitter of the radio controller is so operated to move the vehicle toy backwards, the travelling motor 160 in the drive portion 24 rotated backwards (i.e. in reverse) to move the vehicle toy backwards in the same manner as the above. Then, when the transmitter of the radio controller is so operated as to turn the vehicle toy right or left, and electric current is supplied from the printed board 38 to the magnetic coil 104 of the servo-mechanism 100 in the steering portion 22, so that the magnetic coil 104 is magnetized under the influence of the electric current to produce a magnetic force between the ring-like magnet 103 and the magnetic coil 104, whereby the magnetic coil 104 is rotated through a predetermined angle under the influence of the thus produced magnetic force. The torque of the magnetic coil 104 is transmitted to the left and the right tie rod 12*a*, 12*b* throught the links 108 and 110, so that each of the front wheels 14*a*, 14*b* changes its travelling direction by a predetermined angle, which permits the operator to change the travelling direction of the vehicle toy. Such steering operation becomes the same as that of the conventional radio-controlled vehicle toy, and, therefore, there is no curious feeling in operation in contrast with the tank toy and the like provided with the conventional caterpillars which change travelling direction on the spot. The pair of rows of gear teeth 80, 80 of each of the caterpillar rear wheels 18*a*, 18*b* and the caterpillar front wheels 16*a*, 16*b* mesh with the pair of rows of lower projections 92 of each of the caterpillars 20*a*, 20*b* in a condition in which the caterpillar higher projections 94 are engaged with the grooves 82, so that the caterpillars 20*a*, 20*b* are prevented from being disengaged from the wheels. In addition, manual operation of the lever 118** enables the operator to drive the vehicle toy at any desired speed, i.e. at high speed or at low speed.

In addition, in the vehicle toy of this embodiment of the present invention, since the caterpillar front wheels **16*a*, 16*b* are provided on opposite sides of the chassis main body 26 in the central portion of the vehicle body at a level slightly higher than the flat surface of the road to permit the lower surface of both the left and right caterpillars 20*a*, 20*b* disposed thereunder not to touch the flat surface of the road, the clearance 90 previously described is produced. each of the caterpillars 20*a*, 20*b* has a length equal to half the length of the conventional caterpillar of the tank toy and the like, which make it possible to reduce the caterpillar bearing area of the vehicle toy in comparison with the conventional tank toy and the like, leading to reduction of the travelling load, and thereby enabling the vehicle toy to travel at higher speed. Further, in travelling upon a flat surface of a road such as in on-road driving, the vehicle toy is supported on the road at substantially four points only, namely, the lower portions of the front wheels 14***a*, 14*b* and the portions of the caterpillars 20*a*, 20*b* under the lower portions of the caterpillar rear wheels 18*a*, 18*b*. Consequently, it is possible for the vehicle toy of the present invention to reduce its caterpillar bearing area on flat roads to the extent of that of the conventional four-wheeled vehicle toy, which reduces the load in turning and makes the steering operation smooth. On the other hand, in travelling upon a rough road surface such as in off-road driving, the caterpillar bearing area of the vehicle toy of the present invention increases to range from the caterpillar front wheels 16*a*, 16*b* of the central portion of the vehicle body to the caterpillar rear wheels 18*a*, 18*b*, whereby the vehicle toy is improved in traction and roadability.

Thus, in the present invention, the caterpillars 20*a*, 20*b* extend from the central portion of the vehicle body to the rear portion thereof, while the front wheels 14*a*, 14*b* are controlled by the steering portion 22 to steer similarly in effect to the conventional four-wheeled vehicle toy. Consequently, it is possible to reduce the risk of the vehicle toy of the present invention being stuck in the sand, grass and the like by having available improved traction over a four-wheel drive vehicle toy. Furthermore, in off-road driving, it is possible for the vehicle toy of the present invention to improve its roadability since its caterpillar bearing area increases to range from the central portion of the vehicle body to the rear portion thereof. Thus, the vehicle toy is supported for flat surfaced roads only on the rear caterpillar wheels via the caterpillars and the front road wheels, whereas the forward caterpillar wheels also engage the ground via the caterpillars when travelling over off-road terrain. In on-road driving, it is possible for the operator to control the vehicle toy of the present invention in substantially the same manner as that of the conventional four-wheeled vehicle toy.

Apart from spacing the front of the caterpillars above a flat surface, the caterpillar front wheels 16*a*, 16*b* can be changed in position, according to their shapes and the shapes of the caterpillars and the like.

Further, in the above embodiment of the present invention, the steering portion 22 has been described by using an example of the servo-mechanism 100 provided with the magnetic coil 104 which rotates in the ring-like magnet 102 under the influence of magnetic force. However, the steering portion 22 is not limited to such servo-mechanism 100. The steering portion 22 may use any steering mechanism. In addition, each of the body 10, chassis portion 12, wheels 14*a* and 14*b*, 16*a* and 16*b*, 18*a* and 18*b*, and the caterpillars 20*a*, 20*b* may assume any desired shape, and is not limited to that used in the above embodiment.

As described above, according to the present invention, it is possible for the vehicle toy of the present invention to have the same roadability as that of the vehicle toy provided with conventional caterpillars, provide the same control feeling as that of the conventional four-wheeled vehicle toy, and to reduce the travelling load to enable the vehicle toy of the present invention to travel at high speed.

The above described embodiments, of course, are not to be construed as limiting the breadth of the present invention. Modifications, and other alternative constructions, will be apparent which are within the spirit and scope of the invention as defined in the appended claims.

What is claimed is:

1. A vehicle toy, comprising:

a chassis portion;

a pair of steerable front road wheels rotatably mounted at a front end of the chassis portion;

a steering mechanism supported by the chassis portion and operatively connected to said steerable front road wheels for steering the vehicle toy;

rear caterpillar wheels mounted on each side of the chassis portion at a rear end of the chassis portion;

forward caterpillar wheels mounted on each side of the chassis portion at a location intermediate said front road wheels and said rear caterpillar wheels;

endless belt caterpillar on both sides of the chassis portion and mounted on said forward and rear caterpillar wheels, said forward and rear caterpillar wheels defining the forward and rear extent of said caterpillars;

a drive unit supported by said chassis portion and operatively connected to at least one of said caterpillar wheels on each side of the vehicle chassis for driving said endless belt caterpillars;

said forward caterpillar wheels being disposed at a higher location than needed to support the vehicle toy on a flat surface, so that when said vehicle toy is placed on the flat surface, only said front wheels and a portion of each caterpillar under each rear caterpillar wheel rests on the flat surface, and a lower flight of each caterpillar beginning at each rear caterpillar wheel and extending to under each forward caterpillar wheel is raised above the flat surface; and said forward caterpillar wheels being fixed at said higher location to prevent each caterpillar from contacting said flat surface except at said rear caterpillar wheel whereby the vehicle toy is enabled to handle and perform on said flat surface as a conventional four wheel vehicle toy.

2. The vehicle toy of claim 1, wherein the lower flight of each endless belt caterpillar inclines continuously upwardly in a straight line from below each rear caterpillar wheel to below each forward caterpillar wheel.

3. The vehicle toy of claim 2, wherein said drive unit drives said rear caterpillar wheels.

4. The vehicle toy of claim 3, wherein said vehicle toy has a length and said caterpillars each extend over approximately half the length of the vehicle toy.

5. The vehicle toy of claim 1, further comprising an impact bumper mounted across said front end, said bumper comprising a forwardly and upwardly inclined plate extending forwardly of said front end and said steerable front wheels.

6. The vehicle toy of claim 5, wherein said plate has portions extending transversely in front of said steerable front wheels.

7. The vehicle toy of claim 1, further including a radio control system, and wherein said steering mechanism and said drive unit are separately radio controlled.

8. The vehicle toy of claim 7, wherein said radio control system includes a circuit board supported by said chassis portion at a location between said steering mechanism and said drive unit.

9. The vehicle toy of claim 8, wherein said vehicle toy is battery operated and a battery chamber is located below said circuit board.

10. The vehicle toy of claim 1, wherein said steering mechanism comprises a magnet and a magnet coil, said magnet and said coil being relatively rotatable to each other.

11. The vehicle toy of claim 1, wherein said drive unit includes a manually shiftable two speed transmission.

12. A vehicle toy for travelling over different kinds of ground including off-road terrain and flat surfaces, comprising:

a chassis portion;

a pair of front road wheels rotatably mounted at a front end of said chassis portion and supporting said front end;

rear caterpillar wheels mounted on both sides of the chassis portion at a rear end of the chassis portion;

forward caterpillar wheels mounted on both sides of the chassis portion intermediate said front road wheels and said rear caterpillar wheels;

endless caterpillar belts on both sides of the chassis portion and mounted over said forward and rear caterpillar wheels;

said forward and rear caterpillar wheels defining respectively the forwardmost and rearwardmost extent of the endless caterpillar belts with said caterpillar belts extending approximately half way along the vehicle toy from said rear end towards said front end;

said forward caterpillar wheels being mounted at a fixed height relative to said chassis and at a height above the ground, when a flat surface, greater than an overall radius of each forward caterpillar wheel with the respective caterpillar belt thereon; and a lower flight of each endless caterpillar belt being inclined upwardly from each rear caterpillar wheel to each forward caterpillar wheel with the lower flight rising clear of the ground immediately forwardly of each rear caterpillar wheel when the ground is a flat surface.

13. The vehicle toy of claim 12, further comprising a battery powered, radio controlled drive unit supported by said chassis portion and drivingly connected to said rear caterpillar wheels.

14. The vehicle toy of claim 13, including a plate-like bumper mounted on said chassis portion and inclined upwardly and forwardly to extend forwardly of said front road wheels.

15. A vehicle toy for operation of off-road terrain and flat surfaced road, comprising:

an upper-side vehicle body;

a chassis forming a lower-side vehicle body to support said upper-side vehicle body, said chassis having a front end and a rear portion and having a right side and a left side;

front steerable wheels provided at right and left sides of said front end of said chassis;

forward caterpillar wheels provided on right and left sides of a central portion of said chassis, said central portion being intermediate said front end and said rear portion;

rear caterpillar wheels provided on right and left sides of said rear portion;

right and left caterpillars running round said forward and rear caterpillar wheels on the right and left sides, respectively, of said chassis;

a steering mechanism operatively connected to said front steerable wheels for controlling in direction said front steerable wheels to steer the vehicle toy;

a drive mechanism drivingly connected to said rear caterpillar wheels;

each of said forward caterpillar wheels being mounted on said chassis central portion at a height to raise each caterpillar off a flat surfaced road forwardly of each rear caterpillar wheel, a lower flight of each caterpillar inclining upwards from each rear caterpillar wheel to the respective forward caterpillar wheel; and the vehicle toy only being supported on the flat surfaced road by the rear caterpillar wheels and the front steerable wheels whereby the vehicle toy is able to handle and perform on the flat surfaced road as a conventional four wheel vehicle toy, but on off-road terrain said forward caterpillar wheels also engaging the off-road terrain to enable the vehicle toy to perform with improved traction like a vehicle toy having conventional caterpillars.

16. The vehicle toy of claim 15, further comprising a radio control system, said steering mechanism and said drive mechanism being separately controlled through said radio control system.

* * * * *

UNITED STATES PATENT AND TRADEMARK OFFICE

CERTIFICATE OF CORRECTION

PATENT NO. : 5,261,853

DATED : November 16, 1993

INVENTOR(S) : SUTO

It is certified that error appears in the above-identified patent and that said Letters Patent is hereby corrected as shown below:

In Claim 1, column 10, line 16, "caterpillar" should be -- caterpillars--.

In Claim 15, column 12, line 3, "of" should be --on--.

Signed and Sealed this

Nineteenth Day of April, 1994

Bruce Lehman

*Attest:*

BRUCE LEHMAN

*Attesting Officer*

*Commissioner of Patents and Trademarks*